US007589293B2

(12) United States Patent
Yeh et al.

(10) Patent No.: US 7,589,293 B2
(45) Date of Patent: Sep. 15, 2009

(54) MEMBRANE SWITCH CIRCUIT AND KEYSWITCH USING SUCH MEMBRANE SWITCH CIRCUIT

(75) Inventors: Liang-Ta Yeh, Taipei County (TW); Chih-Chung Yen, Taoyuan County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 12/182,718

(22) Filed: Jul. 30, 2008

(65) Prior Publication Data

US 2009/0032380 A1 Feb. 5, 2009

(30) Foreign Application Priority Data

Aug. 1, 2007 (TW) ..... 96212634 U

(51) Int. Cl.
*H01H 13/702* (2006.01)

(52) U.S. Cl. ..... 200/512; 200/515

(58) Field of Classification Search ..... 200/511–517, 200/344; 400/490–496
See application file for complete search history.

(56) References Cited

U.S. PATENT DOCUMENTS 4,065,649 A * 12/1977 Carter et al. ..... 200/5 A
4,760,217 A * 7/1988 Suzuki et al. ..... 200/5 A
5,770,824 A * 6/1998 Tsai et al. ..... 200/5 A
6,191,776 B1 2/2001 Hu
6,388,219 B2 * 5/2002 Hsu et al. ..... 200/517
6,664,901 B1 * 12/2003 Yamada et al. ..... 341/22
6,880,995 B2 * 4/2005 Cheng ..... 400/491.2
6,946,611 B2 * 9/2005 Yoneyama ..... 200/515
7,378,609 B1 * 5/2008 Fedorjaka ..... 200/516

* cited by examiner

*Primary Examiner*—Michael A Friedhofer
(74) *Attorney, Agent, or Firm*—Morris, Manning & Martin LLP; Tim Tingkang Xia

(57) ABSTRACT

The invention discloses a membrane switch circuit and a keyswitch using such membrane switch circuit. The keyswitch comprises a deformable member, which is disposed on the membrane switch circuit. The membrane switch circuit according to the invention comprises a membrane circuit, an adhering layer, and an insulating layer. The membrane circuit thereon comprises a switch. The adhering layer is formed on the membrane circuit and surrounds the switch. The adhering layer comprises at least one gap. The insulating layer is formed on the adhering layer. The insulating layer has a hole in which the switch is exposed. A bottom of the deformable member is adhered to the insulating layer. In particular, the at least one gap covered by the bottom of the deformable member is utilized as at least one vent.

12 Claims, 3 Drawing Sheets

MEMBRANE SWITCH CIRCUIT AND KEYSWITCH USING SUCH MEMBRANE SWITCH CIRCUIT

BACKGROUND OF THE INVENTION

1. Field of the Invention

The invention relates to a membrane switch circuit and a keyswitch using the membrane switch circuit.

2. Description of the Prior Art

A keyboard, which is the most common input device, can be found in variety of electronic equipments, such as household computer, laptop computer, personal digital assistance (PDA), or the like. A membrane keyboard has been widespread because it produces less noise while pressing a membrane keyswitch.

During the procedures of manufacturing a membrane keyboard, a deformable member is adhered to an insulating layer of a membrane switch circuit. The deformable member is deeply affected by air therein while being pressed. If the keyswitch has a vent, the deformable member will move smoothly when the keyswitch is pressed. Accordingly, the user can use the keyboard with great smoothness.

However, it is a critical consideration about where the vent should be disposed. For example, Hu (U.S. Pat. No. 6,191,776) has disclosed a keyswitch structure with a vent. Although the air can be exhausted from the vent, liquids (e.g. water or beverage) may enter the keyboard through the vent since the vent is disposed on a base plate. Consequently, the circuit within the keyboard may be damaged.

Therefore, the invention discloses a membrane switch circuit and keyswitch using such membrane switch circuit to solve the aforesaid problems.

SUMMARY OF THE INVENTION

A scope of the invention is to provide a membrane switch circuit and a keyswitch using the membrane switch circuit. The keyswitch comprises a deformable member disposed on the membrane switch circuit.

According to an embodiment of the invention, the membrane switch circuit comprises a membrane circuit, an adhering layer, and an insulating layer.

There is a switch disposed on the membrane circuit. The adhering layer is formed on the membrane circuit and surrounds the switch. The adhering layer comprises at least one gap. The insulating layer is formed on the adhering layer. The insulating layer comprises a hole in which the switch is exposed.

A bottom of the deformable member is adhered to the insulating layer. In particular, the at least one gap covered by the bottom of the deformable member is utilized as at least one vent.

According to another embodiment, the invention discloses a keyswitch comprising a keycap, a substrate, a membrane circuit, an adhering layer, an insulating layer, a deformable member, and a supporting device.

The membrane circuit is disposed on the substrate, and there is a switch disposed on the membrane circuit. The adhering layer is formed on the membrane circuit and surrounds the switch. The adhering layer comprises at least one gap. The insulating layer is formed on the adhering layer. The insulating layer comprises a hole in which the switch is exposed. A bottom of the deformable member is adhered to the insulating layer. In particular, the at least one gap covered by the bottom of the deformable member is utilized as at least one vent.

The supporting device is movably disposed between the keycap and the substrate. The supporting device supports the keycap to vertically move relative to the substrate, wherein the deformable member is actuated to switch on the switch in response to the movement of the keycap. Air within the deformable member escapes from the at least one vent when the keycap moves toward the substrate.

Compared with the prior art, since the membrane switch circuit applied in the keyswitch according to the invention has a vent itself, the deformable member will move smoothly when the keyswitch is pressed. Accordingly, the user can use the keyboard with great smoothness. Besides, since the vent is disposed within the membrane switch circuit, it can prevent liquids from entering the keyboard via the vent. Accordingly, the circuit within the keyboard will not be damaged.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
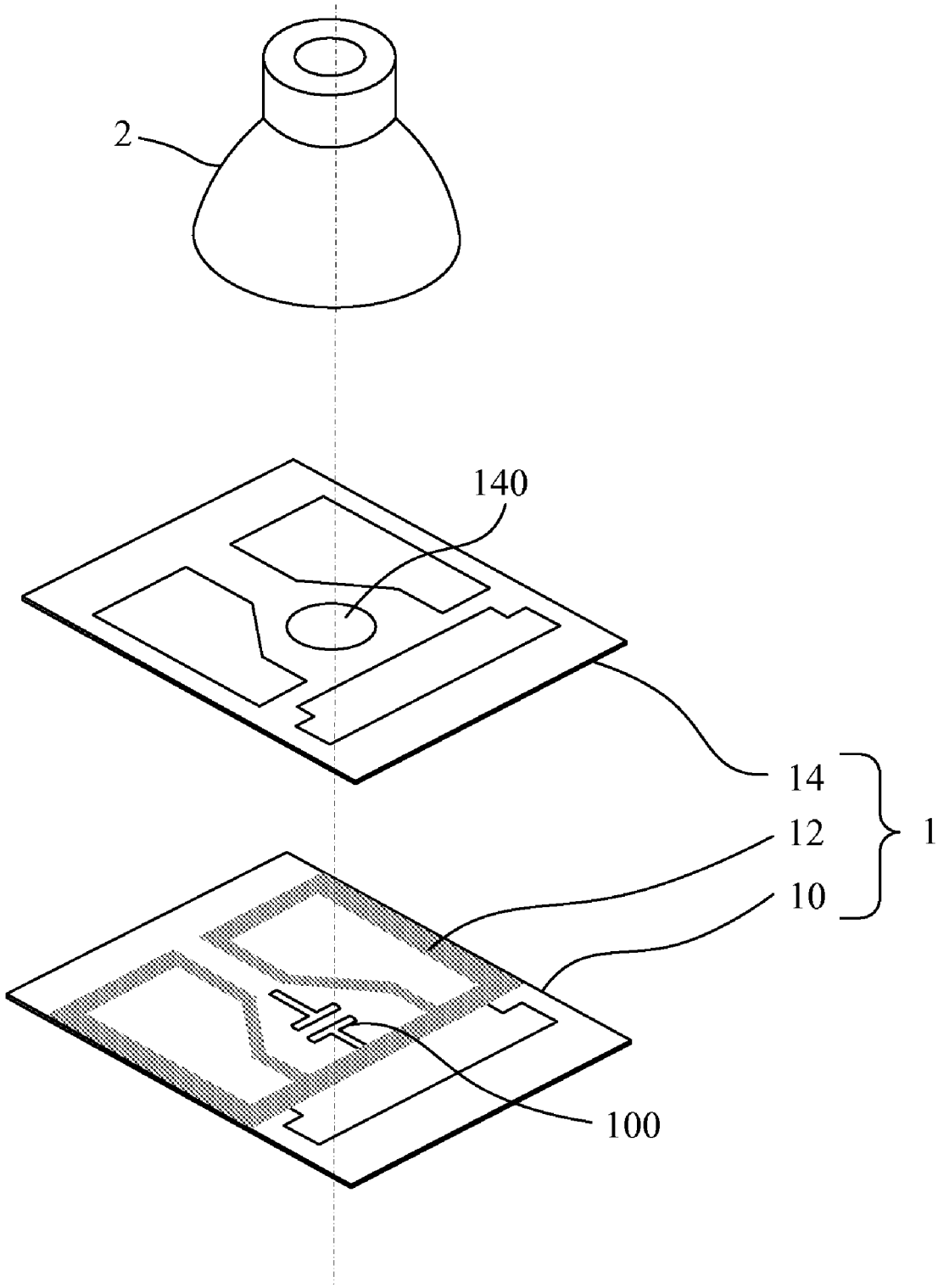
FIG. 1 is an exploded view illustrating a membrane switch circuit used in a keyswitch according to an embodiment of the invention.

Please refer to FIG. 1. FIG. 1 is an exploded view illustrating a membrane switch circuit 1 used in a keyswitch according to an embodiment of the invention. As shown in FIG. 1, a deformable member 2 of the keyswitch (not shown) is disposed upon the membrane switch circuit 1.

As shown in FIG. 1, the membrane switch circuit 1 comprises a membrane circuit 10, an adhering layer 12, and an insulating layer 14.

In an embodiment, the membrane circuit 10 is substantially made of Polyethylene Terephthalate (PET).

There is a switch 100 disposed on the membrane circuit 10. The adhering layer 12 is formed on the membrane circuit 10 and surrounds the switch 100. The adhering layer 12 comprises at least one gap. In this embodiment, the adhering layer 12 comprises, but not limited to, one gap. That is to say, in practical application, the adhering layer 12 may comprise more than one gap.

In an embodiment, the adhering layer 12 is made of, but not limited to, water-proof glue.

Figure 2:
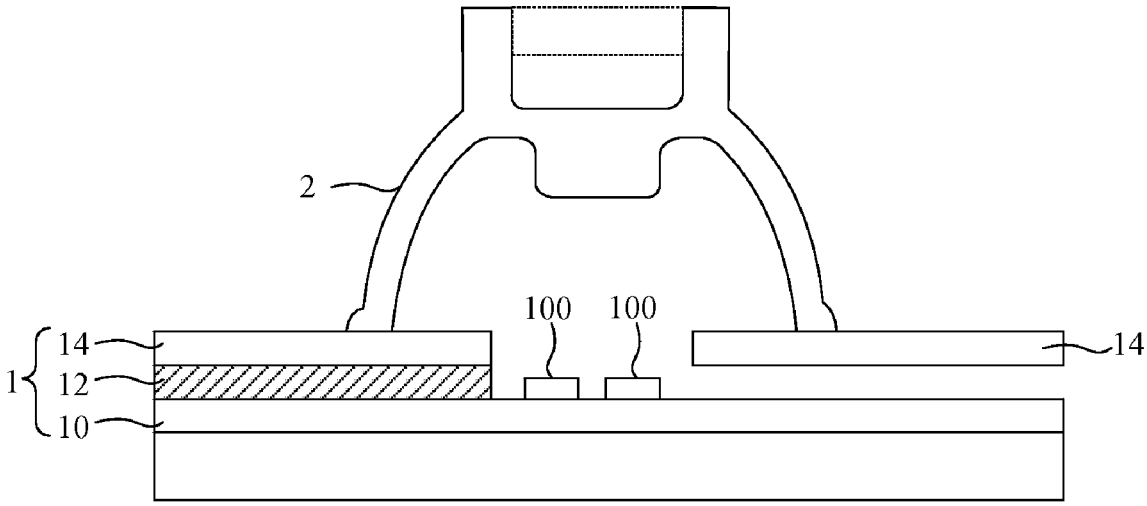
FIG. 2 is a sectional view illustrating the membrane switch circuit 1 shown in FIG. 1.

Please refer to FIG. 2. FIG. 2 is a sectional view illustrating the membrane switch circuit 1 shown in FIG. 1.

As shown in FIG. 2, the insulating layer 14 is formed on the adhering layer 12. The insulating layer 14 comprises a hole 140. The switch 100 is exposed in the hole 140. In practical application, the insulating layer 14 can be made of resin.

A bottom of the deformable member 2 is adhered to the insulating layer 14. In particular, the at least one gap covered by the bottom of the deformable member 2 can be utilized as at least one vent. Therefore, when the deformable member 2 is depressed, air within the deformable member can escape from the at least one vent to the atmosphere. As a result, the deformable member 2 will move smoothly when being pressed. Accordingly, the user can use the keyboard with great smoothness.

Figure 3:
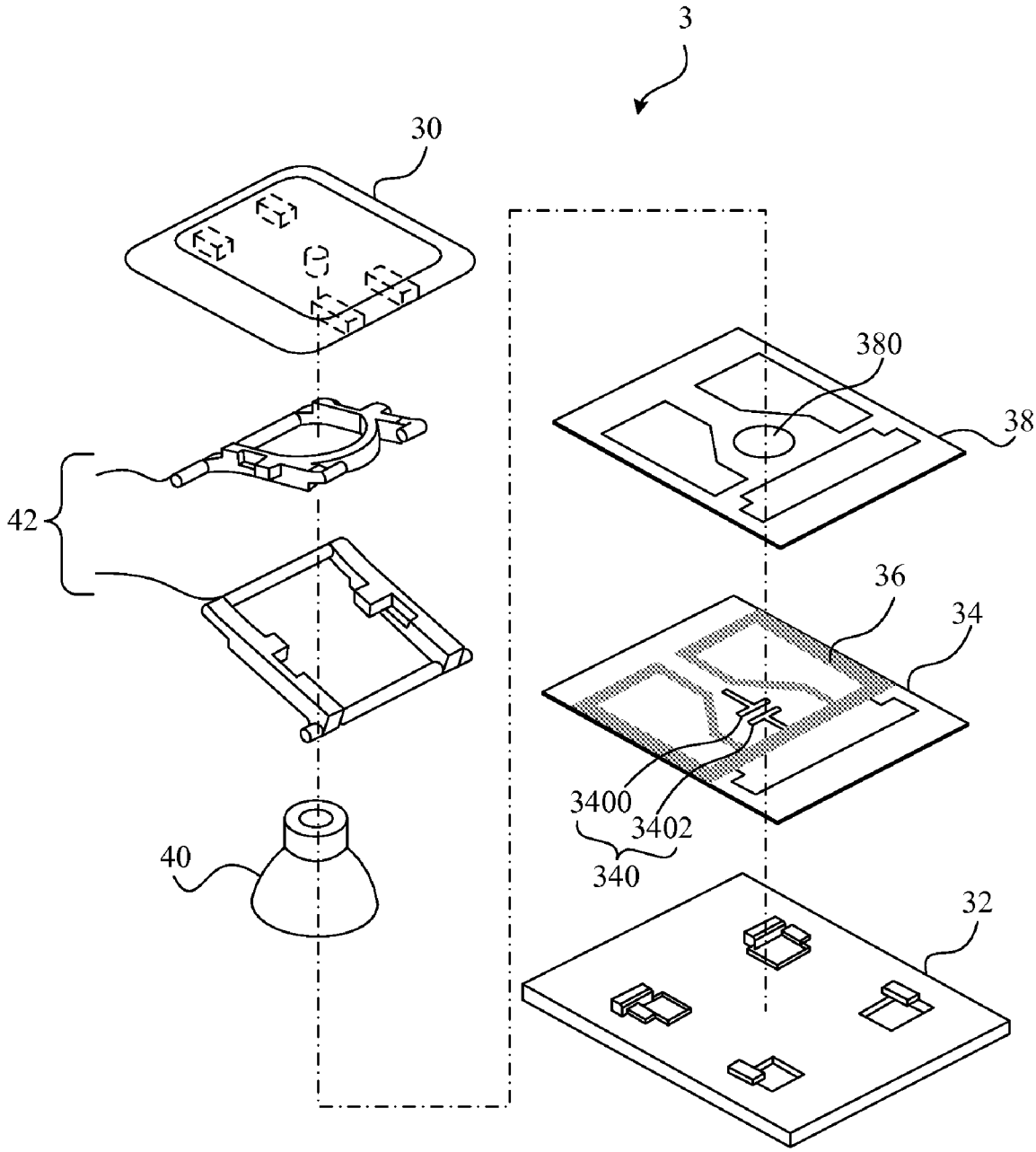
FIG. 3 is an exploded view illustrating a keyswitch according to another embodiment of the invention.

Please refer to FIG. 3. FIG. 3 is an exploded view illustrating a keyswitch 3 according to another embodiment of the invention.

The keyswitch 3 comprises a keycap 30, a substrate 32, a membrane circuit 34, an adhering layer 36, an insulating layer 38, a deformable member 40, and a supporting device 42.

In an embodiment, the membrane circuit 34 is substantially made of Polyethylene Terephthalate (PET).

The membrane circuit 34 is disposed on the substrate 32 and the membrane circuit 34 thereon comprises a switch 340.

The switch 340 comprises a first conductive portion 3400 and a second conductive portion 3402 separated from the first conductive portion 3400. In practical application, the first conductive portion 3400 and the second conductive portion 3402 can be covered by a carbon paste.

The adhering layer 36 is formed on the membrane circuit 34 and surrounds the switch 340. The adhering layer 36 comprises at least one gap. In this embodiment, the adhering layer 36 has, but not limited to, one gap.

In an embodiment, the adhering layer 36 is made of, but not limited to, water-proof glue.

The insulating layer 38 is formed on the adhering layer 36. The insulating layer 38 comprises a hole 380. The switch 340 is exposed in the hole 380. A bottom of the deformable member 40 is adhered to the insulating layer 38. In particular, the at least one gap covered by the bottom of the deformable member 40 is utilized as at least one vent.

The supporting device 42 is movably disposed between the keycap 30 and the substrate 32. The supporting device 42 supports the keycap 30 to vertically move relative to the substrate 32. The deformable member 40 comprises a contact portion (not shown). As the deformable member 40 is pressed in response to the movement of the keycap 30, the contact portion (not shown) contacts the first conductive portion 3400 and the second conductive portion 3402 at the same time, so as to switch on the switch 340. Besides, while the keycap 30 is moving toward the substrate 32, air within the deformable member 40 escapes from the at least one vent.

Compared with the prior art, since the membrane switch circuit applied in the keyswitch according to the invention has a vent itself, the deformable member will move smoothly when the keyswitch is pressed. Accordingly, the user can use the keyboard with great smoothness. Besides, since the vent is disposed within the membrane switch circuit, it can prevent liquids from entering the keyboard via the vent. Accordingly, the circuit within the keyboard will not be damaged.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A membrane switch circuit used in a keyswitch, the keyswitch comprising a deformable member disposed on the membrane switch circuit, the membrane switch circuit comprising:

a membrane circuit thereon comprising a switch;

an adhering layer formed on the membrane circuit, the adhering layer surrounding the switch and comprising at least one gap; and an insulating layer formed on the adhering layer, the insulating layer comprising a hole in which the switch is exposed;

wherein a bottom of the deformable member is adhered to the insulating layer, and the at least one gap covered by the bottom of the deformable member is utilized as at least one vent.

2. The membrane switch circuit of claim 1, wherein the membrane circuit is substantially made of Polyethylene Terephthalate (PET).

3. The membrane switch circuit of claim 1, wherein the insulating layer is made of resin.

4. The membrane switch circuit of claim 1, wherein the adhering layer is made of water-proof glue.

5. The membrane switch circuit of claim 1, wherein the deformable member is made of rubber.

6. A keyswitch, comprising:

a keycap;

a substrate;

a membrane circuit disposed on the substrate, the membrane circuit thereon comprising a switch;

an adhering layer formed on the membrane circuit, the adhering layer surrounding the switch and comprising at least one gap; and an insulating layer formed on the adhering layer, the insulating layer comprising a hole in which the switch is exposed;

a deformable member, a bottom of the deformable member being adhered to the insulating layer, the at least one gap covered by the bottom of the deformable member being utilized as at least one vent; and a supporting device movably disposed between the substrate and the keycap, the supporting device supporting the keycap to vertically move relative to the substrate, wherein the deformable member is actuated to switch on the switch in response to the movement of the keycap, and air within the deformable member escapes from the at least one vent when the keycap moves toward the substrate.

7. The keyswitch of claim 6, wherein the membrane circuit is substantially made of Polyethylene Terephthalate (PET).

8. The keyswitch of claim 6, wherein the insulating layer is made of resin.

9. The keyswitch of claim 6, wherein the adhering layer is made of water-proof glue.

10. The keyswitch of claim 6, wherein the deformable member is made of rubber.

11. The keyswitch of claim 6, wherein the switch comprises a first conductive portion and a second conductive portion separated from the first conductive portion, the deformable member comprises a contact portion, as the deformable member is depressed in response to the movement of the keycap, the contact portion contacts the first conductive portion and the second conductive portion at the same time to switch on the switch.

12. The keyswitch of claim 11, wherein the first conductive portion and the second conductive portion are covered by a carbon paste.

* * * * *